US008321225B1

(12) United States Patent
Jansche et al.

(10) Patent No.: US 8,321,225 B1
(45) Date of Patent: Nov. 27, 2012

(54) GENERATING PROSODIC CONTOURS FOR SYNTHESIZED SPEECH

(75) Inventors: Martin Jansche, New York, NY (US); Michael D. Riley, New York, NY (US); Andrew M. Rosenberg, Brooklyn, NY (US); Terry Tai, Jersey City, NJ (US)

(73) Assignee: Google Inc., Mountain View, CA (US)

( * ) Notice: Subject to any disclaimer, the term of this patent is extended or adjusted under 35 U.S.C. 154(b) by 971 days.

(21) Appl. No.: 12/271,568

(22) Filed: Nov. 14, 2008

(51) Int. Cl.
*G10L 13/00* (2006.01)

(52) U.S. Cl. ..... 704/263; 704/258; 704/260; 704/261; 704/264

(58) Field of Classification Search ..... 704/263, 704/258, 261, 264; 794/263, 258, 261, 264, 794/260

See application file for complete search history.

(56) References Cited

U.S. PATENT DOCUMENTS

| | | | |
|---|---|---|---|
| 6,101,470 | A | 8/2000 | Eide et al. |
| 6,405,169 | B1 | 6/2002 | Kondo et al. |
| 6,470,316 | B1 | 10/2002 | Chihara |
| 6,510,413 | B1 | 1/2003 | Walker |
| 6,535,852 | B2 | 3/2003 | Eide |
| 6,546,367 | B2 | 4/2003 | Otsuka |
| 6,625,575 | B2 | 9/2003 | Chihara |
| 6,636,819 | B1 | 10/2003 | Abbott et al. |
| 6,725,199 | B2 | 4/2004 | Brittan et al. |
| 6,823,309 | B1 | 11/2004 | Kato et al. |
| 6,826,530 | B1 | 11/2004 | Kasai et al. |
| 6,829,581 | B2 | 12/2004 | Meron |
| 6,845,358 | B2 | 1/2005 | Kibre et al. |
| 6,862,568 | B2 | 3/2005 | Case |
| 6,871,178 | B2 | 3/2005 | Case et al. |
| 6,975,987 | B1 | 12/2005 | Tenpaku et al. |
| 6,990,449 | B2 | 1/2006 | Case |
| 6,990,450 | B2 | 1/2006 | Case et al. |
| 7,035,791 | B2 | 4/2006 | Chazan et al. |
| 7,062,439 | B2 | 6/2006 | Brittan et al. |
| 7,076,426 | B1 | 7/2006 | Beutnagel et al. |
| 7,191,132 | B2 | 3/2007 | Brittan et al. |
| 7,200,558 | B2 * | 4/2007 | Kato et al. ..... 704/244 |

(Continued)

OTHER PUBLICATIONS

"Restoring Punctuation and Capitalization in Transcribed Speech", Agustín Gravano, Martin Jansche, Michiel Bacchiani, IEEE International Conference on Acoustics, Speech, and Signal Processing (ICASSP), 2009, pp. 4741-4744.

(Continued)

*Primary Examiner* — Qi Han
(74) *Attorney, Agent, or Firm* — Fish & Richardson P.C.

(57) ABSTRACT

The subject matter of this specification can be implemented in, among other things, a computer-implemented method including receiving text to be synthesized as a spoken utterance. The method includes analyzing the received text to determine attributes of the received text and selecting one or more utterances from a database based on a comparison between the attributes of the received text and attributes of text representing the stored utterances. The method includes determining, for each utterance, a distance between a contour of the utterance and a hypothetical contour of the spoken utterance, the determination based on a model that relates distances between pairs of contours of the utterances to relationships between attributes of text for the pairs. The method includes selecting a final utterance having a contour with a closest distance to the hypothetical contour and generating a contour for the received text based on the contour of the final utterance.

34 Claims, 8 Drawing Sheets

U.S. PATENT DOCUMENTS

| | | | | |
|---|---|---|---|---|
| 7,240,005 | B2 | 7/2007 | Chihara | |
| 7,249,021 | B2 | 7/2007 | Morio et al. | |
| 7,263,488 | B2 | 8/2007 | Chu et al. | |
| 7,308,407 | B2 | 12/2007 | Reich | |
| 7,451,087 | B2 | 11/2008 | Case et al. | |
| 7,472,065 | B2 | 12/2008 | Aaron et al. | |
| 7,487,092 | B2 | 2/2009 | Gleason et al. | |
| 7,496,498 | B2 | 2/2009 | Chu et al. | |
| 7,571,099 | B2 | 8/2009 | Saito et al. | |
| 7,577,568 | B2 | 8/2009 | Busayapongchai et al. | |
| 7,606,701 | B2 | 10/2009 | Degani et al. | |
| 7,844,457 | B2 | 11/2010 | Chen et al. | |
| 7,853,452 | B2 | 12/2010 | Gleason et al. | |
| 7,924,986 | B2 | 4/2011 | Sadowski et al. | |
| 2006/0074678 | A1* | 4/2006 | Pearson et al. | 704/267 |
| 2006/0224380 | A1* | 10/2006 | Hirabayashi et al. | 704/207 |
| 2006/0229877 | A1* | 10/2006 | Tian et al. | 704/267 |
| 2008/0059190 | A1* | 3/2008 | Chu et al. | 704/258 |
| 2009/0076819 | A1* | 3/2009 | Wouters et al. | 704/260 |

OTHER PUBLICATIONS

"Web-derived Pronunciations", Arnab Ghoshal, Martin Jansche, Sanjeev Khudanpur, Michael Riley, Morgan Ulinski, IEEE International Conference on Acoustics, Speech, and Signal Processing (ICASSP), 2009, pp. 4289-4292.

"Web Derived Pronunciations for Spoken Term Detection", Doğan Can, Erica Cooper, Arnab Ghoshal, Martin Jansche, Sanjeev Khudanpur, Bhuvana Ramabhadran, Michael Riley, Murat Saraçlar, Abhinav Sethy, Morgan Ulinski, Christopher White, 32nd Annual International ACM SIGIR Conference, 2009, pp. 83-90.

"A Support Vector Approach to Censored Targets", Pannagadatta Shivaswamy, Wei Chu, Martin Jansche, Seventh IEEE International Conference on Data Mining (ICDM), 2007, pp. 655-660.

"Statistical Modeling for Unit Selection in Speech Synthesis", Cyril Allauzen, Mehryar Mohri, Michael Riley, 42nd Meeting of the Association for Computational Linguistics (ACL 2004), Proceedings of the Conference.

"Voice Signatures", Izhak Shafran, Michael Riley, Mehryar Mohri, Proceedings of the 8th IEEE Automatic Speech Recognition and Understanding Workshop (ASRU 2003).

"On the Correlation between Energy and Pitch Accent in Read English Speech," Andrew Rosenberg, Julia Hirschberg Interspeech 2006, Pittsburgh.

"Intonational Phrases for Speech Summarization," Sameer R. Maskey, Andrew Rosenberg, Julia Hirschberg, Interspeech 2008, Brisbane, Australia.

* cited by examiner

300

| Stress Pattern | Number Stressed | First Stress | Last Stress | Transcript | Parts of Speech | |
|---|---|---|---|---|---|---|
| 1 1 0 1 0 | 3 | 1 | 0 | Let's go to dinner. | TV PN N P N | |
| 1 1 1 0 | 3 | 1 | 0 | Let's eat breakfast. | TV PN V N | |
| . . . | . . . | . . . | . . . | . . . | . . . | . . . |

FIG. 3

GENERATING PROSODIC CONTOURS FOR SYNTHESIZED SPEECH

TECHNICAL FIELD

This instant specification relates to synthesizing speech from text using prosodic contours.

BACKGROUND

Prosody makes human speech natural, intelligible and expressive. Human speech uses prosody in such varied communicative acts as indicating syntactic attachment, topic structure, discourse structure, focus, indirect speech acts, information status, turn-taking behaviors, as well as paralinguistic qualities such as emotion, and sarcasm. The use of prosodic variation to enhance or augment the communication of lexical items is so ubiquitous in speech, human listeners are often unaware of its effects. That is, until a speech synthesis system fails to produce speech with a reasonable approximation of human prosody. Prosodic abnormalities not only negatively impact the naturalness of the synthesized speech, but as prosodic variation is tied to such basic tasks as syntactic attachment and indication of contrast, flouting prosodic norms can lead to degradations of intelligibility. To make synthesized speech as powerful a communication tool as human speech, synthesized speech should at least endeavor to approach human-like prosodic assignment.

SUMMARY

In general, this document describes synthesizing speech from text using prosodic contours. In a first aspect, a computer-implemented method includes receiving text to be synthesized as a spoken utterance. The method further includes analyzing the received text to determine attributes of the received text. The method further includes selecting one or more candidate utterances from a database of stored utterances based on a comparison between the determined attributes of the received text and corresponding attributes of text representing the stored utterances. The method further includes determining, for each candidate utterance, a distance between a contour of the candidate utterance and a hypothetical contour of the spoken utterance to be synthesized, the determination based on a model that relates distances between pairs of contours of the stored utterances to relationships between attributes of text for the pairs. The method further includes selecting a final candidate utterance having a contour with a closest distance to the hypothetical contour. The method further includes generating a contour for the text to be synthesized based on the contour of the final candidate utterance.

Implementations can include any, all, or none of the following features. The relationships between attributes of text for the pairs can include an edit distance between each of the pairs. The method can include selecting a plurality of final candidate utterances having distances that satisfy a threshold and generating the contour for the text to be synthesized based on a combination of the contours of the plurality of final candidate utterances. The method can include selecting k final candidate utterances having the closest distances and generating the contour for the text to be synthesized based on a combination of the contours of the k final candidate utterances, wherein k represents a positive integer. The k final candidate utterances can be combined by averaging the contours of the k final candidate utterances. The method can include rescaling and warping the contour generated from the combination to match the received text to be synthesized as the spoken utterance. The determined attributes of the received text can include an aggregate attribute. The aggregate attribute can include a number of stressed syllables in the received text. The method can include aligning the generated contour with the received text to be synthesized. The method can include outputting the received text to be synthesized with the aligned generated contour to a text-to-speech engine for speech synthesis. Aligning the generated contour can include rescaling an unstressed portion of the generated contour to a longer or a shorter length. Aligning the generated contour can include removing an unstressed portion from the generated contour. Aligning the generated contour can include adding an unstressed portion to the generated contour. The determined attributes of the received text can include an indication of whether or not the received text begins with a stressed portion. The determined attributes of the received text can include an indication of whether or not the received text ends with a stressed portion. Selecting the one or more candidate utterances can include selecting utterances from the database that can have lexical stress patterns that substantially match lexical stress patterns of the received text. The lexical stress patterns can include exact lexical stress patterns or canonical lexical stress patterns.

In a second aspect, a computer-implemented method includes receiving speech utterances encoded in audio data and a transcript having text representing the speech utterances. The method further includes extracting contours from the utterances. The method further includes extracting attributes for text associated with the utterances. The method further includes determining distances between attributes for pairs of utterances. The method further includes determining distances between contours for the pairs of utterances. The method further includes generating a model based on the determined distances for the attributes and the contours, the model adapted to estimate a distance between a determined contour for a received utterance and an unknown contour for a synthesized utterance when given a distance between attributes for text associated with the received utterance and the synthesized utterance. The method further includes storing the model in a computer-readable memory device.

Implementations can include any, all, or none of the following features. The method can include modifying the extracted contours at a time previous to determining the distances between the extracted contours. Extracting the contours from the utterances can include generating for each contour time-value pairs that each include a measurement of a contour value and a time at which the contour value occurs. The extracted contours can include fundamental frequencies, pitches, energy measurements, gain measurements, duration measurements, intensity measurements, measurements of rate of speech, or spectral tilt measurements. The extracted attributes can include exact stress patterns, canonical stress patterns, parts of speech, phone representations, phoneme representations, or indications of declaration versus question versus exclamation. The method can include aligning the utterances in the audio data with text from the transcripts that represents the utterances to determine which speech utterances can be associated with which text. Generating the model can include mapping the distances between the attributes for pairs of utterances to the distances between the contours for the pairs of utterances so as to determine a relationship between the distances associated with the attributes and the distances associated with the contours for pairs of utterances. Extracting the attributes for the text can include comparing the text to an outside reference to determine the attributes. The distances between the contours can be calculated using a root mean square difference calculation. The distances between the attributes can be calculated using an edit distance. The model can be created using a linear regression of the distances between the contours and the distances between the transcripts. The model can be created using only pairs of contours that can be aligned to one another. The method can include selecting pairs of utterances for use in determining distances based on whether the utterances can have canonical stress patterns that match. The method can include creating multiple models, including the model, where each of the models has a different canonical stress pattern. Modifying the contours can include normalizing times in the time and value pairs to a predetermined length. Modifying the contours can include normalizing values in the time and values pairs using a z-score normalization. The method can include selecting, based on estimated distances between a plurality of determined contours and an unknown contour of text to be synthesized, a final determined contour associated with a smallest distance. The method can include generating a contour for the text to be synthesized using the final determined contour. The method can include outputting the generated contour and the text to be synthesized to a speech-to-text engine for speech synthesis.

In a third aspect, a computer-implemented system includes one or more computers having an interface to receive text to be synthesized as a spoken utterance. The system further includes a text analyzer to analyze the received text to determine attributes of the received text. The system further includes a candidate identifier to select one or more candidate utterances from a database of stored utterances based on a comparison between the determined attributes of the received text and corresponding attributes of text representing the stored utterances. The system further includes means for determining a distance between a contour of a candidate utterance and a hypothetical contour of the spoken utterance to be synthesized, the determination based on a model that relates distances between pairs of contours of the stored utterances to distances between attributes of text for the pairs and selecting a final candidate utterance having a contour with a closest distance to the hypothetical contour. The system further includes a contour aligner to generate a contour for the text to be synthesized based on the contour of the final candidate utterance.

In a fourth aspect, a computer-implemented system includes one or more computers having an interface to receive speech utterances encoded in audio data and a transcript having text representing the speech utterances. The system further includes a contour extractor to extract contours from the utterances. The system further includes a transcript analyzer to extract attributes for text associated with the utterances. The system further includes an attribute comparer to determine distances between attributes for pairs of utterances. The system further includes a contour comparer to determine distances between contours for the pairs of utterances. The system further includes means for generating a model based on the determined distances for the attributes and the contours, the model adapted to estimate a distance between a determined contour for a received utterance and an unknown contour for a synthesized utterance when given a distance between attributes for text associated with the received utterance and the synthesized utterance. The system further includes a computer-readable memory device associated with the one or more computers to store the model.

The systems and techniques described here may provide one or more of the following advantages. First, a system can provide improved prosody for text-to-speech synthesis. Second, a system can provide a wider range of candidate contours from which to select a prosody for use in text-to-speech synthesis. Third, a system can provide improved or minimized processor usage during identification of candidate contours and/or selection of a final contour from the candidate contours. Fourth, a system can predict or estimate how accurate a stored contour represents a text to be synthesized by using a model that takes as input a comparison between lexical attributes of the text and a transcript of the contour.

The details of one or more embodiments are set forth in the accompanying drawings and the description below. Other features and advantages will be apparent from the description and drawings, and from the claims.

DESCRIPTION OF DRAWINGS

FIG. 3 is an example of a table for storing transcript analysis information.

Like reference symbols in the various drawings indicate like elements.

DETAILED DESCRIPTION

This document describes systems and techniques for making synthesized speech sound more natural by assigning prosody (e.g., stress and intonation patterns of an utterance) to the synthesized speech. In some implementations, prosody is assigned by storing naturally occurring contours (e.g., fundamental frequencies $f_0$) extracted from human speech, selecting a best naturally occurring contour at speech synthesis time, and aligning the selected contour to the text that is being synthesized.

In some implementations, the contour is selected by estimating a distance, or a calculated difference, between contours based on differences between features of text associated with the contours. A model for estimating these distances can be generated by analyzing audio data and corresponding transcripts of the audio data. The model can then be used at run-time to estimate a distance between stored contours and a hypothetical contour for text to be synthesized.

In some implementations, the distance estimate between a stored contour and an unknown contour is based on comparing attributes of the text to be synthesized with attributes of text associated with the stored contours. Based on the distance between the attributes, the model can generate an estimate between the stored contours associated with the text and the hypothetical contour. The contour with the smallest estimated distance can be selected and used to generate a contour for the text to be synthesized.

In some implementations, the results comparing the attributes can be something other than an edit distance. In some implementations, measurement of differences between some attributes may not translate easily to an edit distance. For example, the text may include a final punctuation from each utterance. Some utterances may end with a period, some may end with a question mark, some may end with a comma, and some may end with no punctuation at all. The edit distance between a comma and a period in this example may not be intuitive or may not accurately represent the differences between an utterance ending in a comma or period versus an utterance ending in a question mark. In this case, the list of possible end punctuation can be used as an enumerated list. Distances between pairs of contours can be associated with a particular pairing of end punctuation, such as period and comma, question mark and period, or comma and no end punctuation.

In general, the process determines for each candidate utterance, a distance between a contour of the candidate utterance and a hypothetical contour of the spoken utterance to be synthesized. The determination is based on the model that relates distances between pairs of contours of the stored utterances to relationships between attributes of text for the pairs, such as an edit distance between attributes of the pairs or an enumeration of pairs of attribute values. This process is described in detail below.

Figure 1:
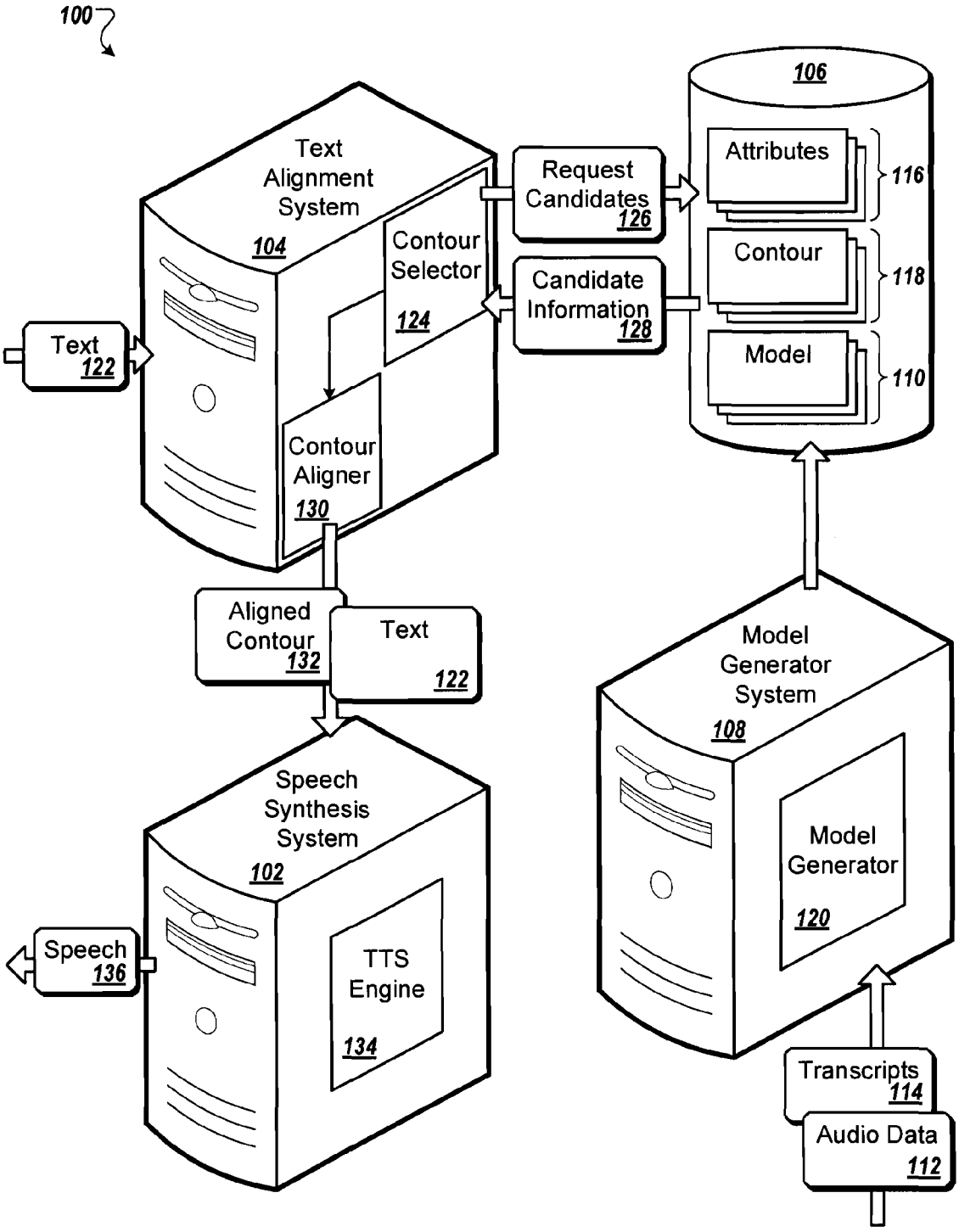
FIG. 1 is a schematic diagram showing an example of a system that selects a contour for use in text-to-speech synthesis.

FIG. 1 is a schematic diagram showing an example of a system 100 that selects a contour for use in text-to-speech synthesis. The system 100 includes a speech synthesis system 102, a text alignment system 104, a database 106, and a model generator system 108. The contour selection begins with the model generator system 108 generating one or more models 110 to be used in the contour selection process. In some implementations, the models 110 can be generated at "design time" or "offline." For example, the models 110 can be generated at any time before a request to perform a text-to-speech synthesis is received.

The model generator system 108 receives audio, such as audio data 112, and one or more transcripts 114 corresponding to the audio data 112. The model generator system 108 analyzes the transcripts 114 to determine one or more attributes 116 of the language elements in each of the transcripts 114. For example, the model generator system 108 can perform lexical lookups to determine sequences of parts-of-speech (e.g., noun, verb, preposition, adjective, etc.) for sentences or phrases in the transcripts 114. The model generator system 108 can perform a lookup to determine stress patterns (e.g., primary stress, secondary stress, or unstressed) of syllables, phonemes, or other units of language in the transcripts 114. The model generator system 108 can determine other attributes, such as whether sentences in the transcripts 114 are declarations, questions, or exclamations. The model generator system 108 can determine a phone or phoneme representation of the words in the transcripts 114.

The model generator system 108 extracts one or more contours 118 from the audio data 112. In some implementations, the contours 118 include time-value pairs that represent the pitch or fundamental frequency of a portion of the audio data 112 at a particular time. In some implementations, the contours 118 include other time-value pairs, such as energy, duration, speaking rate, intensity, or spectral tilt.

The model generator system 108 includes a model generator 120. The model generator 120 generates the models 110 by determining a relationship between differences in the contours 118 and differences in the transcripts 114. For example, the model generator system 108 can determine a root mean square difference (RMSD) between pitch values in pairs of the contours 118 and an edit distance between one or more attributes of corresponding pairs of the transcripts 114. The model generator 120 performs a linear regression on the differences between the pairs of the contours 118 and the corresponding pairs of the transcripts 114 to determine a model or relationship between the differences in the contours 118 and the differences in the transcripts 114.

The model generator system 108 stores the attributes 116, the contours 118, and the models 110 in the database 106. In some implementations, the model generator system 108 also stores the audio data 112 and the transcripts 114 in the database 106. The relationships represented by the models 110 can later be used to estimate a difference between one or more of the contours 118 and an unknown contour of a text 122 to be synthesized. The estimate is based on differences between the attributes 116 of the contours 118 and attributes of the text 122.

The text alignment system 104 receives the text 122 to be synthesized. The text alignment system 104 analyzes the text to determine one or more attributes of the text 122. At least one attribute of the text 122 corresponds to one of the attributes 116 of the transcripts 114.

For example, the attribute can be an exact lexical stress pattern or a canonical lexical stress pattern. A canonical lexical stress pattern includes an aggregate or simplified representation of a corresponding complete or exact lexical stress pattern. For example, a canonical lexical stress pattern can include a total number of stressed elements in a text or transcript, an indication of a first stress in the text or transcript, and/or an indication of a last stress in the text or transcript.

The text alignment system 104 includes a contour selector 124. The contour selector 124 sends a request 126 for contour candidates to the database 106. The database 106 may reside at the text alignment system 104 or at another system, such as the model generator system 108.

The request 126 includes a query for contours associated with one or more of the transcripts 114 where the transcripts 114 have an attribute that matches the attribute of the text 122. For example, the contour selector 124 can request contours having a canonical lexical stress pattern attribute that matches the canonical lexical stress pattern attribute of the text 122. In another example, the contour selector 124 can request contours having an exact lexical stress pattern attribute that matches the exact lexical stress pattern attribute of the text 122.

In some implementations, multiple types of attribute values from the text 122 can be queried from the attributes 116. For example, the contour selector 124 can make a first request for candidate contours using a first attribute value of the text 122 (e.g., the canonical lexical stress pattern). If the set of results from the first request is too large (e.g., above a predetermined threshold number of results), then the contour selector 124 can refine the query using a second attribute value of the text 122 (e.g., the exact lexical stress pattern, parts-of-speech sequence, or declaration vs. question vs. exclamation). Alternatively, if the set of results from a first request is too small (e.g., below a predetermined threshold number of results), then the contour selector 124 can broaden the query (e.g., switch from exact lexical stress pattern to canonical lexical stress pattern).

The database 106 provides the search results to the text alignment system 104 as candidate information 128. In some implementations, the candidate information 128 includes a set of the contours 118 to be used as prosody candidates for the text 122. The candidate information 128 can also include at least one of the attributes 116 for each of the candidate contours and at least one of the models 110.

In some implementations, the identified model is created by the model generator system 108 using the subset of the contours 118 (e.g., the candidate contours) having associated transcripts with attributes that match one another. As a result of the query, the attributes of the candidate contours also match the attribute of the text 122. In some implementations, the candidate contours have the property that they can be aligned to one another and to the text 122. For example, the attributes of the candidate contours and the text 122 either have matching exact lexical stress patterns or matching canonical lexical stress patterns, such that a correspondence can be made between at least the stressed elements of the candidate contours and the text 122 as well as and the particular stress of the first and last elements.

The contour selector 124 calculates an edit distance between the attributes of the text 122 and the attributes of each of the candidate contours. The contour selector 124 uses the identified model and the calculated edit distances to estimate RMSDs between an as yet unknown contour of the text 122 and the candidate contours. The candidate contour having the smallest RMSD is selected as the prosody contour for use in the speech synthesis of the text 122. The contour selector 124 provides the text 122 and the selected contour to a contour aligner 130.

The contour aligner 130 aligns the selected contour onto the text 122. For example, where a canonical lexical stress pattern is used to identify candidate contours, the selected contour may have a different number of unstressed elements than the text 122. The contour aligner 130 can expand or contract an existing region of unstressed elements in the selected contour to match the unstressed elements in the text 122. The contour aligner 130 can add a region of one or more unstressed elements within a region of stressed elements in the selected contour to match the unstressed elements in the text 122. The contour aligner 130 can remove a region of one or more unstressed elements within a region of stressed elements in the selected contour to match the unstressed elements in the text 122.

The contour aligner 130 provides the text 122 and an aligned contour 132 to the speech synthesis system 102. The speech synthesis system includes a text-to-speech engine (TTS) 134 that processes the aligned contour 132 and the text 122. The TTS 134 uses the prosody from the aligned contour 132 to output the synthesized text as speech 136.

Figure 2:
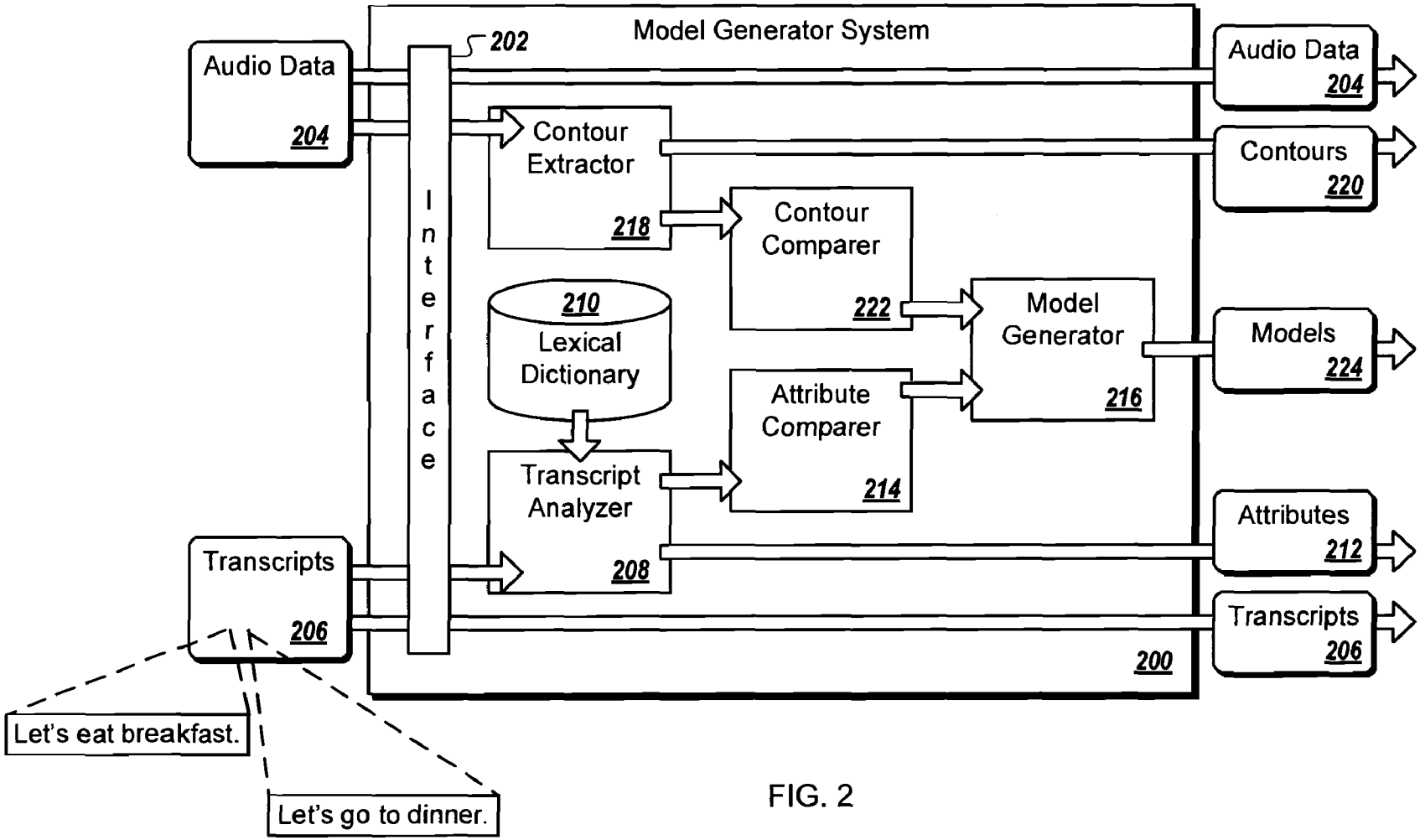
FIG. 2 is a block diagram showing an example of a model generator system.

FIG. 2 is a block diagram showing an example of a model generator system 200. The model generator system 200 includes an interface 202 for receiving audio, such as audio data 204, and one or more transcripts 206 of the audio data 204. The model generator system 200 also includes a transcript analyzer 208. The transcript analyzer 208 uses to a lexical dictionary 210 to identify one or more attributes 212 in the transcripts 206, such as part-of-speech attributes and lexical stress pattern attributes.

In one example, a first transcript may include the text "Let's go to dinner" and a second transcript may include the text "Let's eat breakfast." The first transcript has a parts-of-speech sequence including "verb-pronoun-verb-preposition-noun" and the second transcript has a parts-of-speech sequence including "verb-pronoun-verb-noun." In some implementations, the parts-of-speech attributes can be retrieved from the lexical dictionary 210 by looking up the corresponding words from the transcripts 206 in the lexical dictionary 210. In some implementations, the contexts of other words in the transcripts 206 are used to resolve ambiguities in the parts-of-speech.

In another example of identified attributes, the transcript analyzer 208 can use the lexical dictionary to identify a lexical stress pattern for each of the transcripts 206. For example, the first transcript has a stress pattern of "stressed-stressed-unstressed-stressed-unstressed" and the second transcript has a stress pattern of "stressed-stressed-stressed-unstressed." In some implementations, a more restrictive stress pattern can be used, such as by separately considering primary stress and secondary stress. In some implementations, a less restrictive lexical stress pattern can be used, such as the canonical lexical stress pattern. For example, the first and second transcripts both have a canonical lexical stress pattern of three total stressed elements, a stressed first element, and an unstressed last element.

The transcript analyzer 208 outputs the attributes 212, for example to a storage device such as the database 106. The transcript analyzer 208 also provides the attributes to an attribute comparer 214. The attribute comparer 214 determines attribute differences between transcripts that have matching lexical stress patterns (e.g., exact or canonical) and provides the attribute differences to a model generator 216. For example, the attribute comparer 214 identifies the transcript "Let's go to dinner" and "Let's eat breakfast" as having matching canonical lexical stress patterns.

In some implementations, the attribute comparer 214 calculates the attribute difference as the edit distance between attributes of the transcripts. For example, the attribute comparer 214 can calculate the edit distance between the parts-of-speech attributes as one (e.g., one can arrive at the parts-of-speech in the first transcript by a single insertion of a preposition in the second transcript). In some implementations, a more restrictive set of speech parts can be used, such as transitive verbs versus intransitive verbs. In some implementations, a less restrictive set of speech parts can be used, such as by combining pronouns and nouns into a single part-of-speech category.

In some implementations, edit distances between other attributes can be calculated, such as an edit distance between stress pattern attributes. The stress pattern edit distance between the first and second transcripts is one (e.g., one can arrive at the exact lexical stress pattern of the second transcript by a single insertion of an unstressed element in the first transcript).

In some implementations, an attribute other than lexical stress can used to match comparisons of transcript attributes, such as parts-of-speech. In some implementations, all transcripts can be compared, a random sample of transcripts can be compared, and/or most frequently used transcripts can be compared.

The model generator system 200 includes a contour extractor 218. The contour extractor 218 receives the audio data 204 through the interface 202. The contour extractor 218 processes the audio data 204 to extract one or more contours 220 corresponding to each of the transcripts 206. In some implementations, the contours 220 include time-value pairs of the fundamental frequency or pitch at various time locations in the audio data 204. For example, the time can be measured in seconds from the beginning of a particular audio data and the frequency can be measured in Hertz (Hz).

In some implementations, the contour extractor 218 normalizes the length of each of the contours 220 to a predetermined length, such as a unit length or one second. In some implementations, the contour extractor 218 normalizes the values in the time-value pairs. For example, the contour extractor 218 can use z-score normalization to normalize the frequency values for a particular speaker. The contour's mean frequency is subtracted from each of its individual frequency values and each result is divided by the standard deviation of the frequency values of the contour. In some implementations, the mean and standard deviation of a speaker may be applied to multiple contours using z-score normalization. The means and standard deviations used in the z-score normalization can be stored and used later to de-normalize the contours.

The contour extractor 218 stores the contours 220 in a storage device, such as the database 106, and provides the contours 220 to a contour comparer 222. The contour comparer 222 calculates differences between the contours. For example, the contour comparer 222 can calculate a RMSD between each pair of contours where the contours have associated transcripts with matching lexical stress patterns (e.g., exact or canonical). In some implementations, all contours can be compared, a random sample of contours can be compared, and/or most frequently used contours can be compared. For example, the following equation can be used to calculate the RMSD between a pair of contours ($Contour_1$, $Contour_2$), where each contour has a particular value at a given time (t).

$$RMSD = \sqrt{\sum_t (Contour_1(t) - Contour_2(t))^2} \qquad \text{Equation 1}$$

The contour comparer 222 provides the contour differences to the model generator 216. The model generator 216 uses the sets of corresponding transcript differences and contour differences having associated matching lexical stress patterns to generate one or more models 224. For example, the model generator 216 can perform a linear regression for each set of contour differences and transcript differences to determine an equation that estimates contour differences based on attribute differences for a particular lexical stress pattern.

In some implementations, the RMSD between two contours may not be symmetric. For example, when the canonical lexical stress patterns match but the exact lexical stress patterns do not match then the RMSD may not be the same in both directions. In the case where spans of unstressed elements are added or removed, the RMSD between the contours is asymmetric. Where the RMSD is not symmetric, the distance between a pair of contours can be calculated as a combination or a sum of the RMSD from the first (Contour') to the second ($Contour_2$) and the RMSD from the second ($Contour_2$) to the first ($Contour_1$). For example, the following equation can be used to calculate the RMSD between a pair of contours, where each contour has a particular value at a given time (t) and the RMSD is asymmetric.

$$RMSD = \sqrt{\sum_t (Contour_1(t) - Contour_2(t))^2} + \sqrt{\sum_t (Contour_2(t) - Contour_1(t))^2} \qquad \text{Equation 2}$$

The model generator 216 stores the models 224 in a storage device, such as the database 106. In some implementations, the model generator system 200 stores the audio data 204 and the transcripts 206 in a storage device, such as the database 106, in addition to the attributes 212 and other prosody data. The attributes 212 are later used, for example, at runtime to identify prosody candidates from the contours 220. The models 224 are used to select a particular one of the candidate contours on which to align a text to be synthesized.

Prosody information stored by the model generator system 200 can be stored in a device internal to the model generator system 200 or external to the model generator system 200, such as a system accessible by a data communications network. While shown here as a single system, operations performed by the model generator system 200 can be distributed across multiple systems. For example, a first system can process transcripts, a second system can process audio data, and a third system can generate models. In another example, a first set of transcripts, audio data, and/or models can be performed at a first system while a second set of transcripts, audio data, and/or models can be performed at a second system.

FIG. 3 is an example of a table 300 for storing transcript analysis information. The table 300 includes a first transcript having the words "Let's go to dinner" and a second transcript having the words "Let's eat breakfast." As previously described, a module such as the transcript analyzer 208 can determine exact lexical stress patterns "1 1 0 1 0" and "1 1 1 0" (where "1" corresponds to stressed and "0" corresponds to unstressed), and/or canonical lexical stress patterns "3 1 0" and "3 1 0" for the first and second transcripts, respectively. The transcript analyzer 208 can also determine the parts-of-speech sequences "transitive verb (TV), pronoun (PN), intransitive verb (IV), preposition (P), noun (N)," and "transitive verb (TV), pronoun (PN), verb (V), noun (N)" for the words in the first and second transcripts, respectively. The table 300 can include other attributes determined by analysis of the transcripts as well as data including the time-value pairs representing the contours.

Figure 4:
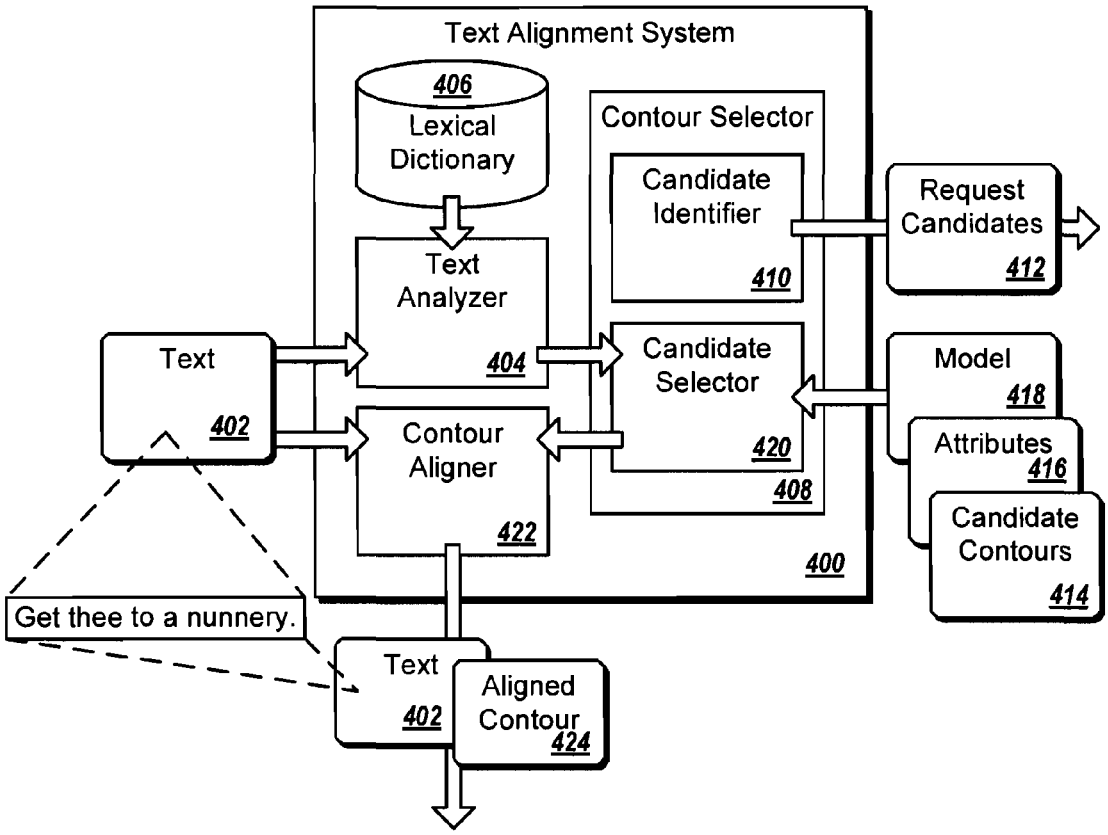
FIG. 4 is a block diagram showing an example of a text alignment system.

FIG. 4 is a block diagram showing an example of a text alignment system 400. The text alignment system 400 receives a text 402 to be synthesized into speech. For example, the text alignment system can receive the text 402 including "Get thee to a nunnery."

The text alignment system 400 includes a text analyzer 404 that analyzes the text 402 to determine one or more attributes of the text 402. For example, the text analyzer 404 can use a lexical dictionary 406 to determine a parts-of-speech sequence (e.g., transitive verb, pronoun, preposition, indefinite article, and noun), an exact lexical stress pattern (e.g., "1 1 0 0 1 0 0"), a canonical lexical stress pattern (e.g., "3 1 0"), phone or phoneme representations of the text 402, or function-context words in the text 402.

The text analyzer 404 provides the attributes of the text 402 to a contour selector 408. The contour selector 408 includes a candidate identifier 410 that uses the attributes of the text 402 to send a request 412 for candidate contours having attributes that match the attribute of the text 402. For example, the candidate identifier 410 can query a database, such as the database 106, using the canonical lexical stress pattern of the text 402 (e.g., three total stressed elements, a first stressed element, and a last unstressed element).

The contour selector 408 receives one or more candidate contours 414, as well as one or more attributes 416 of transcripts corresponding to the candidate contours 414, and at least one model 418 associated with the candidate contours 414. For example, the attributes 416 may include the exact lexical stress patterns of the transcripts associated with the candidate contours 414. The contour selector 408 includes a candidate selector 420 that selects one of the candidate contours 414 that has a smallest estimated contour difference with the text 402.

The candidate selector 420 calculates a difference between an attribute of the text 402 and each of the attributes 416 from the transcripts of the candidate contours 414. The type of attribute being compared can be the same attribute used to identify the candidate contours 414, another attribute, or a combination of attributes that may include the attribute used to identify the candidate contours 414. In some implementations, the attribute difference is an edit distance (e.g., the number of individual substitutions, insertions, or deletions needed to make the compared attributes match).

For example, the candidate selector 420 can determine that the edit distance between the exact lexical stress pattern of the text 402 (e.g., "1 1 0 0 1 0 0") and the exact lexical stress pattern of the first transcript (e.g., "1 1 0 1 0") is two (e.g., either insertion or removal of two unstressed elements). The candidate selector 420 can determine that the edit distance between the exact lexical stress pattern of the text 402 (e.g., "1 1 0 0 1 0 0") and the exact lexical stress pattern of the second transcript (e.g., "1 1 1 0") is three (e.g., either insertion or removal of three unstressed elements).

In some implementations, the candidate selector 420 can compare a type of attribute other than lexical stress to determine the edit distance. For example, the candidate selector 420 can determine an edit distance between the parts-of-speech sequences for the text 402 and the transcripts associated with the candidate contours.

In some implementations, insertions or deletions of unstressed regions are not allowed at the beginning or the end of the transcripts. In some implementations, the beginning and end of a unit of text, such as a phrase, sentence, paragraph, or other typically bounded grouping of words in speech can have important contour features at the beginning and/or end. In some implementations, preventing addition or removal of unstressed regions at the beginning and/or end preserves the important contour information at the beginning and/or end. In some implementations, the inclusion of the first stress and last stress in the canonical lexical stress pattern provides this protection of the beginning and/or end of a contour associated with a transcript.

The candidate selector 420 passes the calculated attributes edit distances into the model 418 to determine an estimated RMSD between a proposed contour of the text 402 and each of the candidate contours 414. The candidate selector 420 selects the candidate contour that has the smallest RMSD with the contour of the text 402. The candidate selector 420 provides the selected candidate contour to a contour aligner 422.

The contour aligner 422 aligns the selected contour to the text 402. For example, where a canonical lexical stress pattern is used to identify the candidate contours 414, the selected one of the candidate contours 414 may have an associated exact lexical stress pattern that is different than the exact lexical stress pattern of the text 402. The contour aligner 422 can expand or contract unstressed one or more regions in the selected contour to align the contour to the text 402. For example, if the first transcript having the exact lexical stress pattern "1 1 0 1 0" is the selected candidate contour, then the contour aligner 422 expands both of the unstressed elements into double unstressed elements to match the exact lexical stress pattern "1 1 0 0 1 0 0" of the text 402. Alternatively, if the second transcript having the exact lexical stress pattern "1 1 1 0" is the selected candidate contour, then the contour aligner 422 inserts two unstressed elements between the second and third stressed elements and also expands the last unstressed element into two unstressed elements to match the exact lexical stress pattern "1 1 0 0 1 0 0" of the text 402.

In some implementations, the contour aligner 422 also de-normalizes the selected candidate contour. For example, the contour aligner 422 can reverse the z-score value normalization by multiplying the contour values by a standard deviation of the frequency and adding a mean of the frequency for a particular voice. In another example, the contour aligner 422 can de-normalize the time length of the selected candidate contour. The contour aligner 422 can proportionately expand or contract each time interval in the selected candidate contour to arrive at an expected time length for the contour as a whole. The contour aligner 422 outputs an aligned contour 424 and the text 402 for use in speech synthesis, such as at the speech synthesis system 102.

Figure 5A:
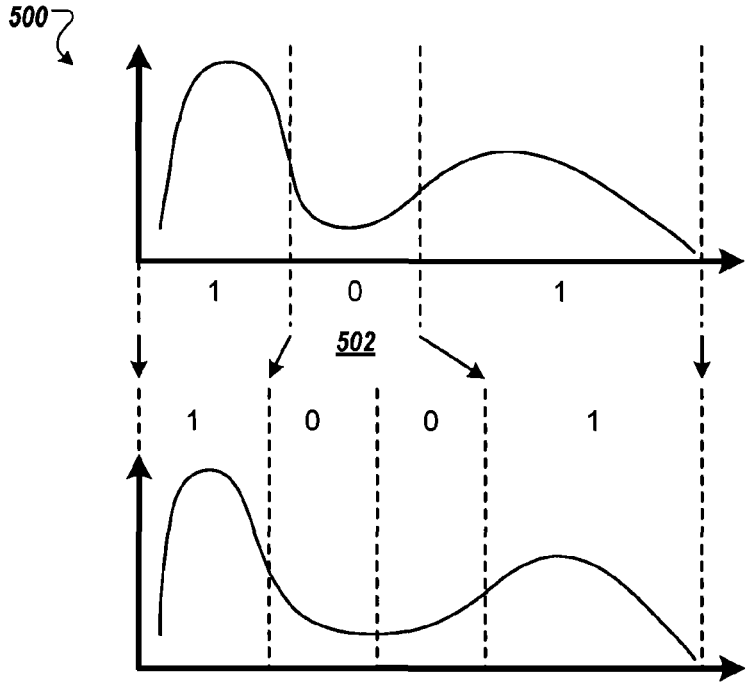
FIGS. 5A-C are examples of contour graphs showing alignment of a contour to a different lexical stress pattern.

FIG. 5A is an example of a pair of contour graphs 500 before and after expanding an unstressed region 502. The unstressed region 502 is expanded from one unstressed element to two unstressed elements, for example, to match the exact lexical stress pattern of a text to be synthesized. In this example, the overall time length of the contour remains the same after the expansion of the unstressed region 502. In some implementations, an unstressed element added by an expansion has a predetermined time length. In some implementations, the other elements in the contour (stressed or unstressed) are accordingly and proportionately contracted to maintain the same overall time length after the expansion.

Figure 5B:
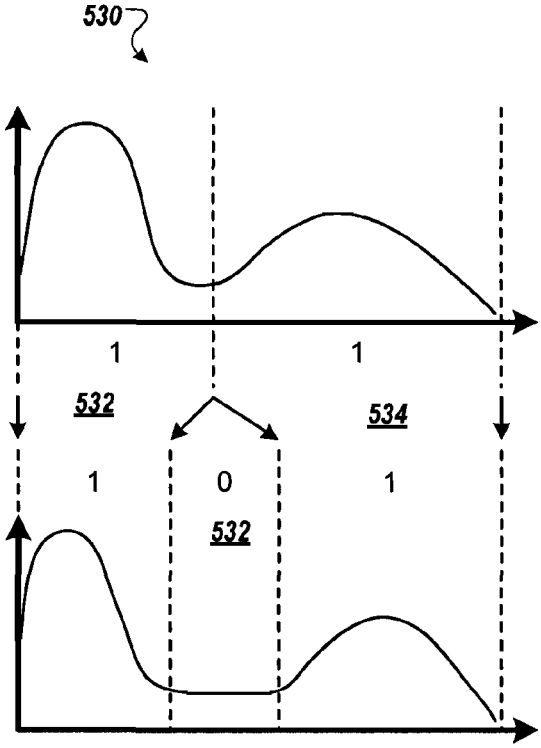

FIG. 5B is an example of a pair of contour graphs 530 before and after inserting an unstressed region 532 between a pair of stressed elements 534. In some implementations, the unstressed region 532 has a constant frequency, such as the frequency at which the pair of stressed elements 534 were divided. Alternatively, the values in the unstressed region 532 can be smoothed to prevent discontinuities at the junctions with the pair of stressed elements 534. Again, the overall time length of the contour remains the same after the insertion of the unstressed region 532. In some implementations, an unstressed element added by an insertion has a predetermined time length. In some implementations, the other elements in the contour (stressed or unstressed) are accordingly and proportionately contracted to maintain the same overall time length after the expansion.

Figure 5C:
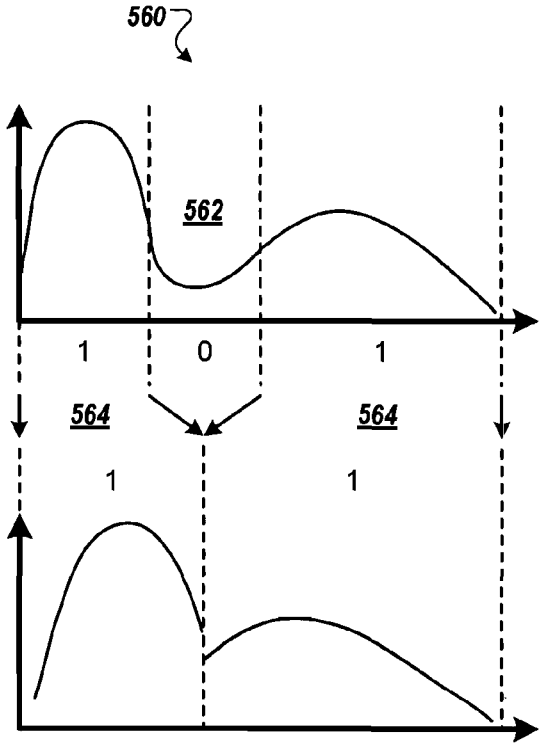

FIG. 5C is an example of a pair of contour graphs 560 before and after removing an unstressed region 562 between a pair of stressed regions 564. In some implementations, the values in the pair of stressed regions 564 can be smoothed to prevent discontinuities at the junction with one another. Again, the overall time length of the contour remains the same after the removal of the unstressed region. In some implementations, the other elements in the contour (stressed or unstressed) are accordingly and proportionately expanded to maintain the same overall time length after the removal.

The following flow charts show examples of processes that may be performed, for example, by a system such as the system 100, the model generator system 200, and/or the text alignment system 400. For clarity of presentation, the description that follows uses the system 100, the model generator system 200, and the text alignment system 400 as the basis of examples for describing these processes. However, another system, or combination of systems, may be used to perform the processes.

Figure 6:
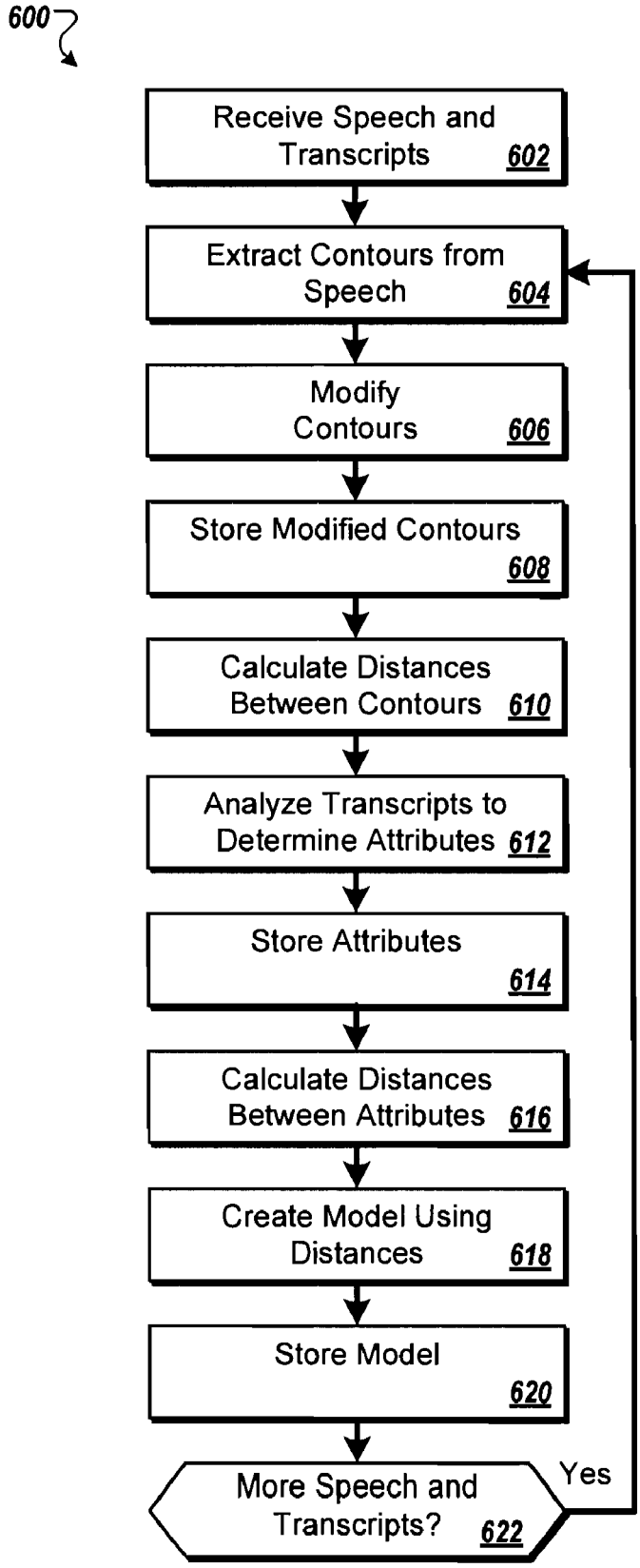
FIG. 6 is a flow chart showing an example of a process for generating models.

FIG. 6 is a flow chart showing an example of a process 600 for generating models. The process 600 begins with receiving (602) multiple speech utterances and corresponding transcripts of the speech utterances. For example, the model generator system 200 can receive the audio data 204 and the transcripts 206 through the interface 202. In some implementations, the audio data 204 and the transcripts 206 include transcribed audio such as television broadcast news, audio books, and closed captioning for movies to name a few. In some implementations, the amount of transcribed audio processed by the model generator system 200 or distributed over multiple model generation systems can be very large, such as hundreds of thousands or millions of corresponding contours.

The process 600 extracts (604) one or more contours from each of the speech utterances, each of the contours including one or more time and value pairs. For example, the contour extractor 218 can extract time-value pairs for fundamental frequency at various times in each of the speech utterances to generate a contour for each of the speech utterances.

The process 600 modifies (606) the extracted contours. For example, the contour extractor 218 can normalize the time length of each contour and/or normalize the frequency values for each contour. In some implementations, normalizing the contours allows the contours to be compared and aligned more easily.

The process 600 stores (608) the modified contours. For example, the model generator system 200 can output the contours 220 and store them in a storage device, such as the database 106.

The process 600 calculates (610) one or more distances between the stored contours. For example, the contour comparer 222 can determine a RMSD between pairs of the contours 220. In some implementations, the contour comparer 222 compares all possible pairs of the contours 220. In some implementations, the contour comparer 222 compares a random sampling of pairs from the contours 220. In some implementations, the contour comparer 222 compares pairs of the contours 220 that have a matching attribute value, such as a matching canonical lexical stress pattern.

The process 600 analyzes (612) the transcripts to determine one or more attributes of the transcripts. For example, the transcript analyzer 208 can use the lexical dictionary 210 to analyze the transcripts 206 and determine parts-of-speech sequences, exact lexical stress patterns, canonical lexical stress patterns, phones, and/or phonemes.

The process 600 stores (614) at least one of the attributes for each of the transcripts. For example, the model generator system 200 can output the attributes 212 and store them in a storage device, such as the database 106.

The process 600 calculates (616) one or more distances between the attributes. For example, the attribute comparer 214 can calculate a difference or edit distance between one or more attributes for a pair of the transcripts 206. In some implementations, the attribute comparer 214 compares all possible pairs of the transcripts 206. In some implementations, the attribute comparer 214 compares a random sampling of pairs from the transcripts 206. In some implementations, the attribute comparer 214 compares pairs of the transcripts 206 that have a matching attribute value, such as a matching canonical lexical stress pattern.

The process 600 creates (618) a model, using the distances between the contours and the distances between the transcripts, that estimates a distance between contours of an utterance pair based on a distance between attributes of the utterance pair. For example, the model generator 216 can perform a multiple linear regression on the RMSD values and the attribute edit distances for a set of utterance pairs (e.g., all utterance pairs with transcripts having a particular canonical lexical stress pattern).

The process 600 stores (620) the model. For example, the model generator system 200 can output the models 224 and store them in a storage device, such as the database 106.

If more speech and corresponding transcripts exist (622), the process 600 performs operations 604 through 620 again. For example, the model generator system 200 can repeat the model generation process for each attribute value used to group the pairs of utterances. In one example, the model generator system 200 identifies each of the different canonical lexical stress patterns that exist in the utterances. Further, the model generator system 200 repeats the model generation process for each set of utterance pairs having a particular canonical lexical stress pattern. A first model may represent pairs of utterances having a canonical lexical stress pattern of "3 1 0," while a second model may represent pairs of utterances having a canonical lexical stress pattern of "4 0 0."

Figure 7:
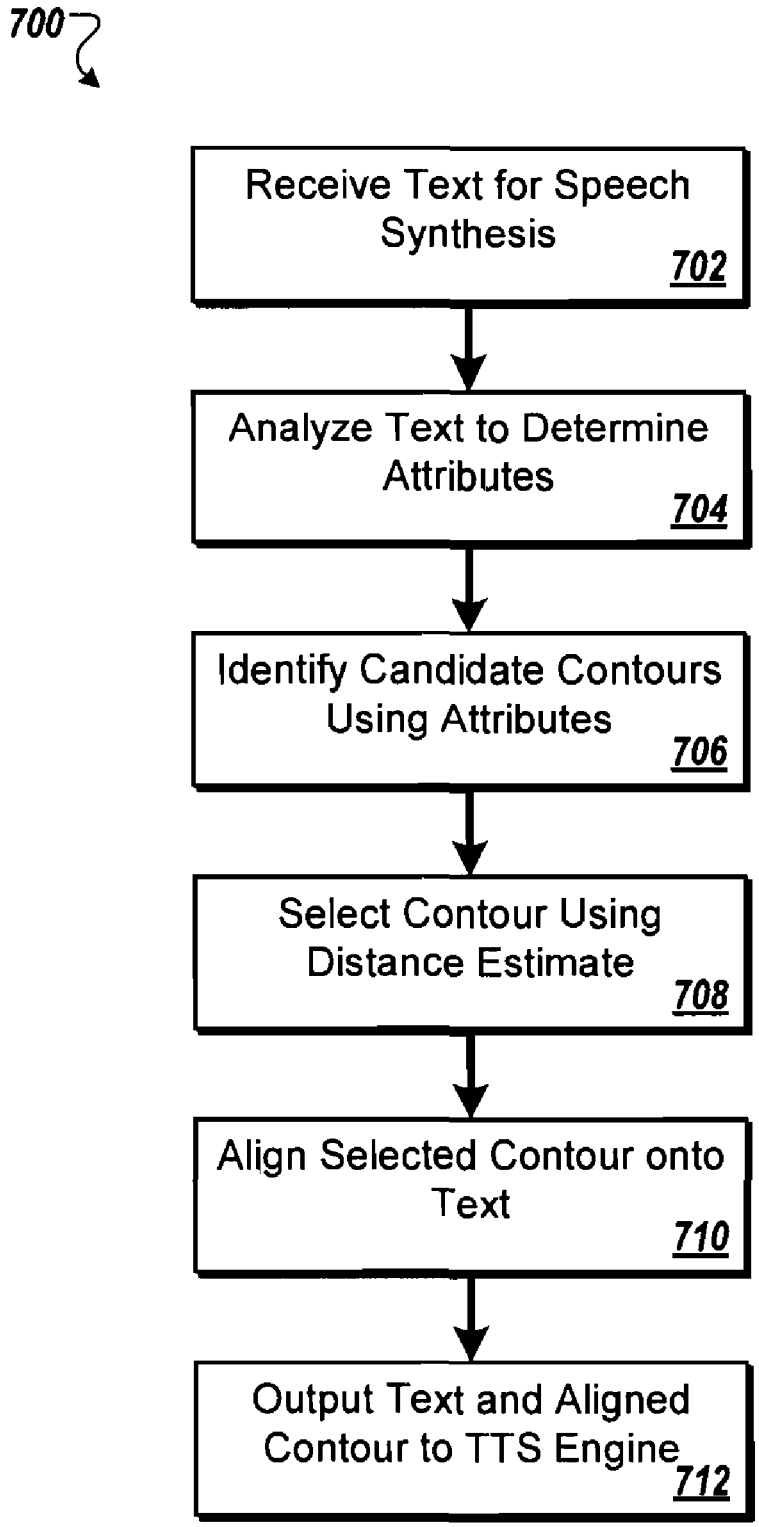
FIG. 7 is a flow chart showing an example of a process for selecting and aligning a contour.

FIG. 7 is a flow chart showing an example of a process 700 for selecting and aligning a contour. The process 700 begins with receiving (702) text to be synthesized as speech. For example, the text alignment system 400 receives the text 402, for example, from a user or an application seeking speech synthesis.

The process 700 analyzes (704) the received text to determine one or more attributes of the received text. For example, the text analyzer 404 analyzes the text 402 to determine one or more lexical attributes of the text 402, such as a parts-of-speech sequence, an exact lexical stress pattern, a canonical lexical stress pattern, phones, and/or phonemes.

The process 700 identifies (706) one or more candidate utterances from a database of stored utterances based on the determined attributes of the received text and one or more corresponding attributes of the stored utterances. For example, the candidate identifier 410 uses at least one of the attributes of the text 402 to identify the candidate contours 414. The candidate identifier 410 also identifies the model 418 associated with the candidate contours 414. In some implementations, the candidate identifier 410 uses the attribute of the text 402 as a key value to query the corresponding attributes of the contours in the database. For example, the candidate identifier 410 can perform a query for contours having a canonical lexical stress pattern of "3 1 0."

The process 700 selects (708) at least one of the identified candidate utterances using a distance estimate based on stored distance information in the database for the stored utterances. For example, the candidate selector 420 can use the model 418 to determine an estimated distance between a hypothetical contour of the text 402 and the candidate contours 414. The candidate selector 420 provides as input to the model 418, at least one lexical attribute edit distance between the text 402 and each of the candidate contours 414. The candidate selector 420 selects a final contour from the candidate contours 414 that has the smallest estimated contour distance away from the text 402.

In some implementations, the candidate selector 420 selects multiple final contours. For example, the candidate selector 420 can select multiple final contours and then average the multiple contours to determine a single final contour. The candidate selector 420 can select a predetermined number of final contours and/or final contour that meet a predetermined proximity threshold of estimated distance from the text 402.

The process 700 aligns (710) a contour of the selected candidate utterance with the received text. For example, the contour aligner 422 aligns the final contour onto the text 402. In some implementations, aligning can include modify an exiting unstressed region by expanding or contracting the number of unstressed elements in the unstressed region, inserting an unstressed region with at least one unstressed element, or removing an unstressed region completely. In some implementations, insertions and removals do not occur at the beginning and/or end of a contour. In some implementations, each contour represents a self-contained linguistic unit, such as a phrase or sentence. In some implementations, each element at which a modification, insertion, or removal occurs represents a subpart of the contour, such as a word, syllable, phoneme, phone, or individual character.

The process 700 outputs (712) the received text with the aligned contour to a text-to-speech engine. For example, the text alignment system 400 can output the text and the aligned contour 424 to a TTS engine, such as the TTS 134.

Figure 8:
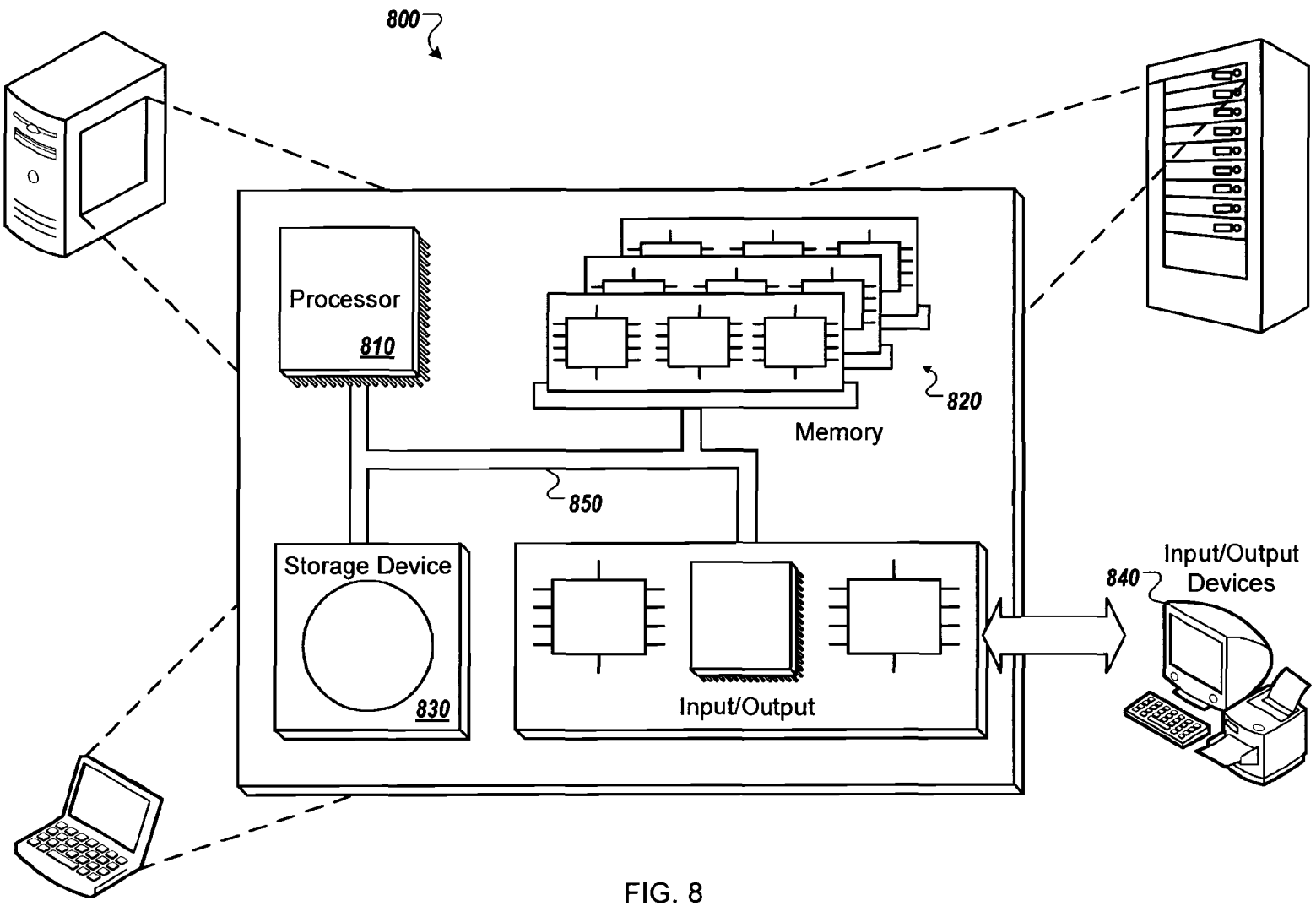
FIG. 8 is a schematic diagram showing an example of a computing system that can be used in connection with computer-implemented methods and systems described in this document.

FIG. 8 is a schematic diagram of a computing system 800. The computing system 800 can be used for the operations described in association with any of the computer-implement methods and systems described previously, according to one implementation. The computing system 800 includes a processor 810, a memory 820, a storage device 830, and an input/output device 840. Each of the processor 810, the memory 820, the storage device 830, and the input/output device 840 are interconnected using a system bus 850. The processor 810 is capable of processing instructions for execution within the computing system 800. In one implementation, the processor 810 is a single-threaded processor. In another implementation, the processor 810 is a multi-threaded processor. The processor 810 is capable of processing instructions stored in the memory 820 or on the storage device 830 to display graphical information for a user interface on the input/output device 840.

The memory 820 stores information within the computing system 800. In one implementation, the memory 820 is a computer-readable medium. In one implementation, the memory 820 is a volatile memory unit. In another implementation, the memory 820 is a non-volatile memory unit.

The storage device 830 is capable of providing mass storage for the computing system 800. In one implementation, the storage device 830 is a computer-readable medium. In various different implementations, the storage device 830 may be a floppy disk device, a hard disk device, an optical disk device, or a tape device.

The input/output device 840 provides input/output operations for the computing system 800. In one implementation, the input/output device 840 includes a keyboard and/or pointing device. In another implementation, the input/output device 840 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, e.g., in a machine-readable storage device or in a propagated signal, for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) monitor for displaying information to the user and a keyboard and a pointing device such as a mouse or a trackball by which the user can provide input to the computer.

The features can be implemented in a computer system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include, e.g., a LAN, a WAN, and the computers and networks forming the Internet.

The computer system can include clients and servers. A client and server are generally remote from each other and typically interact through a network, such as the described one. The relationship of client and server arises by virtue of computer programs running on the respective computers and having a client-server relationship to each other.

Although a few implementations have been described in detail above, other modifications are possible. For example, while described above as separate offline and runtime processes, one or more of the models 110 can be calculated during or after receiving the text 122. The particular models to be created after receiving the text 122 can be determined, for example, by the stress pattern of the text 122 (e.g., exact or canonical).

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other implementations are within the scope of the following claims.

What is claimed is:

1. A method implemented by a system of one or more computers, comprising:

receiving, at the system, text to be synthesized as a spoken utterance;

analyzing, by the system, the received text to determine attributes of the received text;

selecting, by the system, one or more candidate utterances from a database of stored utterances based on a comparison between the determined attributes of the received text and corresponding attributes of text representing the stored utterances;

determining, by the system for each candidate utterance, a distance between a prosodic contour of the candidate utterance and a hypothetical prosodic contour of the spoken utterance to be synthesized, the determination based on a model that relates a) distances between prosodic contours of pairs of the stored utterances to b) relationships between attributes of text of each of the respective pairs, wherein the model is embodied by information including, for each of the stored utterances:

a prosodic contour of the respective stored utterance, one or more attributes of text of the respective stored utterance, and first data relating a difference between the prosodic contour of the respective stored utterance to the prosodic contour of a second stored utterance to a difference between a first attribute of the text of the respective stored utterance and the first attribute of the text of the second stored utterance, second data relating a difference between the prosodic contour of the respective stored utterance to the prosodic contour of a third stored utterance to a difference between the first attribute of the text of the respective stored utterance and the first attribute of the text of the third stored utterance, wherein the second stored utterance and the third stored utterance are in the stored utterances, and wherein prosodic contours represent prosodic characteristics of speech at different times;

selecting, by the system, a final candidate utterance having a prosodic contour with a closest distance to the hypothetical prosodic contour; and generating, by the system, a prosodic contour for the text to be synthesized based on the contour of the final candidate utterance.

2. The method of claim 1, wherein the relationships between attributes of text for the pairs include an edit distance between each of the pairs.

3. The method of claim 1, further comprising selecting, by the system, a plurality of final candidate utterances having distances that satisfy a threshold and generating the prosodic contour for the text to be synthesized based on a combination of the prosodic contours of the plurality of final candidate utterances.

4. The method of claim 1, further comprising selecting, by the system, k final candidate utterances having the closest distances and generating the prosodic contour for the text to be synthesized based on a combination of the prosodic contours of the k final candidate utterances, wherein k represents a positive integer.

5. The method of claim 4, wherein the k final candidate utterances are combined by averaging the prosodic contours of the k final candidate utterances.

6. The method of claim 4, further comprising rescaling and warping, by the system, the prosodic contour generated from the combination to match the received text to be synthesized as the spoken utterance.

7. The method of claim 1, wherein the determined attributes of the received text include an aggregate attribute.

8. The method of claim 7, wherein the aggregate attribute includes a number of stressed syllables in the received text.

9. The method of claim 1, further comprising aligning, by the system, the generated prosodic contour with the received text to be synthesized.

10. The method of claim 9, further comprising outputting, from the system, the received text to be synthesized with the aligned generated prosodic contour to a text-to-speech engine for speech synthesis.

11. The method of claim 9, wherein aligning the generated prosodic contour includes rescaling an unstressed portion of the generated prosodic contour to a longer or a shorter length.

12. The method of claim 9, wherein aligning the generated prosodic contour includes removing an unstressed portion from the generated prosodic contour.

13. The method of claim 9, wherein aligning the generated prosodic contour includes adding an unstressed portion to the generated prosodic contour.

14. The method of claim 1, wherein the determined attributes of the received text include an indication of whether or not the received text begins with a stressed portion.

15. The method of claim 1, wherein the determined attributes of the received text include an indication of whether or not the received text ends with a stressed portion.

16. The method of claim 1, wherein selecting the one or more candidate utterances includes selecting utterances from the database that have lexical stress patterns that substantially match lexical stress patterns of the received text.

17. The method of claim 16, wherein the lexical stress patterns comprise exact lexical stress patterns or canonical lexical stress patterns.

18. The method of claim 1, wherein the model embodies relationships of a) root mean square differences between prosodic contours of pairs of the stored utterances to b) the relationships between the attributes of text for the respective pairs.

19. The method of claim 1, wherein the model embodies relationships of a) root mean square differences between pitch values of prosodic contours of pairs of the stored utterances to b) the relationships between the attributes of text for the respective pairs.

20. The method of claim 1, wherein the model embodies relationships between all prosodic contours in the database of stored utterances and the relationships between the attributes of text of the respective pairs.

21. The method of claim 1, wherein the model embodies relationships between a random sample of prosodic contours in the database of stored utterances and the relationships between the attributes of text of the respective pairs in the random sample.

22. The method of claim 1, wherein the model embodies relationships between a sample of the most frequently used prosodic contours in the database of stored utterances and the relationships between the attributes of text of the respective pairs in the sample.

23. A computer-implemented system comprising:

one or more computers having:

an interface to receive text to be synthesized as a spoken utterance;

a text analyzer to analyze the received text to determine attributes of the received text;

a candidate identifier to select one or more candidate utterances from a database of stored utterances based on a comparison between the determined attributes of the received text and corresponding attributes of text representing the stored utterances;

means for determining a distance between a prosodic contour of a candidate utterance and a hypothetical prosodic contour of the spoken utterance to be synthesized, the determination based on a model that relates a) distances between prosodic contours of pairs of the stored utterances to b) distances between attributes of text of each of the respective pairs and for selecting a final candidate utterance having a prosodic contour with a closest distance to the hypothetical prosodic contour, wherein prosodic contours represent prosodic characteristics of speech at different times; and a prosodic contour aligner to generate a prosodic contour for the text to be synthesized based on the prosodic contour of the final candidate utterance;

wherein the system further comprises a memory for storing data for access by the means for determining the distance, the memory comprising information embodying the model used by the means for determining the distance, the information including, for each of the stored utterances:

a prosodic contour of the respective stored utterance, one or more attributes of text of the respective stored utterance, and first data relating a difference between the prosodic contour of the respective stored utterance to the prosodic contour of a second stored utterance to a difference between a first attribute of the text of the respective stored utterance and the first attribute of the text of the second stored utterance, and second data relating a difference between the prosodic contour of the respective stored utterance to the prosodic contour of a third stored utterance to a difference between the first attribute of the text of the respective stored utterance and the first attribute of the text of the third stored utterance, wherein the second stored utterance and the third stored utterance are in the stored utterances.

24. The system of claim 23, wherein the system is programmed to select a plurality of final candidate utterances that have distances that satisfy a threshold and to generate the prosodic contour for the text to be synthesized based on a combination of the prosodic contours of the plurality of final candidate utterances.

25. The system of claim 23, wherein the system is programmed to select k final candidate utterances that have the closest distances and to generate the prosodic contour for the text to be synthesized based on a combination of the prosodic contours of the k final candidate utterances, wherein k represents a positive integer.

26. The system of claim 23, wherein the system is further programmed to align the generated prosodic contour with the received text to be synthesized.

27. The system of claim 26, wherein aligning the generated prosodic contour includes rescaling an unstressed portion of the generated prosodic contour to a longer or a shorter length.

28. The system of claim 23, wherein selecting the one or more candidate utterances includes selecting utterances from the database that have lexical stress patterns that substantially match lexical stress patterns of the received text.

29. A computer-implemented system comprising:

a computer interface arranged to receive text to be synthesized as a spoken utterance;

a text analyzer to analyze the received text to determine attributes of the received text;

a candidate identifier to select one or more candidate utterances from a database of stored utterances based on a comparison between the determined attributes of the received text and corresponding attributes of text representing the stored utterances;

a candidate selector to determine distances between respective prosodic contours of a candidate utterance and the spoken utterance using a model that relates a) distances between respective prosodic contours of pairs of the stored utterances to b) distances between attributes of text of each of the respective pairs, and to select a final candidate utterance based on the determined distances; and a memory for storing data for access by the candidate selector, the memory comprising information embodying the model used by the candidate selector, the information including, for each of the stored utterances:

a prosodic contour of the respective stored utterance, one or more attributes of text of the respective stored utterance, and first data relating a difference between the prosodic contour of the respective stored utterance to the prosodic contour of a second stored utterance to a difference between a first attribute of the text of the respective stored utterance and the first attribute of the text of the second stored utterance, second data relating a difference between the prosodic contour of the respective stored utterance to the prosodic contour of a third stored utterance to a difference between the first attribute of the text of the respective stored utterance and the first attribute of the text of the third stored utterance, wherein the second stored utterance and the third stored utterance are in the stored utterances, wherein prosodic contours represent prosodic characteristics of speech at different times.

30. The system of claim 29, further comprising a prosodic contour aligner to generate a prosodic contour for the text to be synthesized based on the prosodic contour of the final candidate utterance.

31. The system of claim 30, wherein aligning the generated prosodic contour includes rescaling an unstressed portion of the generated prosodic contour to a longer or a shorter length.

32. The system of claim 29, wherein the candidate selector is programmed to (a) select a plurality of final candidate utterances that have distances that satisfy a threshold, and (b) generate the prosodic contour for the text to be synthesized based on a combination of the prosodic contours of the plurality of final candidate utterances.

33. The system of claim 29, wherein the candidate selector is programmed to select k final candidate utterances that have the closest distances and to generate the prosodic contour for the text to be synthesized based on a combination of the prosodic contours of the k final candidate utterances, wherein k represents a positive integer.

34. The system of claim 29, wherein selecting the one or more candidate utterances includes selecting utterances from the database that have lexical stress patterns that substantially match lexical stress patterns of the received text.

* * * * *